US010434433B1

(12) United States Patent
Thai et al.

(10) Patent No.: US 10,434,433 B1
(45) Date of Patent: Oct. 8, 2019

(54) BUBBLE GENERATING APPARATUS

(71) Applicant: Placo Bubbles Limited, TST East, Kowloon (HK)

(72) Inventors: Jessica Shono Thai, Kowloon (HK); Jason Shono Thai, Kowloon (HK); Douglas Thai, Kowloon (HK)

(73) Assignee: Placo Bubbles Limited, Hong Kong (HK)

( * ) Notice: Subject to any disclaimer, the term of this patent is extended or adjusted under 35 U.S.C. 154(b) by 0 days.

(21) Appl. No.: 16/124,626

(22) Filed: Sep. 7, 2018

(51) Int. Cl.
*A63H 33/28* (2006.01)
*A63H 29/22* (2006.01)

(52) U.S. Cl.
CPC ..... *A63H 33/28* (2013.01); *A63H 29/22* (2013.01)

(58) Field of Classification Search
CPC ..... A63H 33/28; A63H 29/22
USPC ..... 446/15, 16, 17, 18, 19, 20
See application file for complete search history.

(56) References Cited

U.S. PATENT DOCUMENTS 6,682,570 B2 1/2004 Thai
7,367,861 B2 5/2008 Thai
8,075,363 B2 * 12/2011 Gomzar ..... A63H 33/28 446/15
8,123,584 B2 2/2012 Thai
2001/0035413 A1 * 11/2001 Thai ..... A63H 33/28 220/213
2005/0148276 A1 * 7/2005 LaFata ..... A63H 31/08 446/18
2006/0094325 A1 * 5/2006 Thai ..... A63H 33/28 446/16
2012/0214378 A1 * 8/2012 Lo ..... A63H 33/28 446/15

* cited by examiner

*Primary Examiner* — Vishu K Mendiratta
(74) *Attorney, Agent, or Firm* — Raymond Sun

(57) ABSTRACT

A bubble generating device has a bubble generating assembly positioned adjacent a front opening. The bubble generating assembly has a support frame having a stationary wiping element which has an opening through which bubble solution leaks out. The bubble generating assembly also has a plurality of bubble rings coupled to the support frame for rotation in a manner where each of the plurality of bubble rings individually wipes across the wiping element at the location of the opening. A motor is positioned inside the housing and has a fan that is directed to blow air towards the front opening. Bubble solution is delivered from a container to the wiping element. A link assembly couples the motor and the support ring in a manner in which actuation of the trigger causes the support ring to be rotated so that each of the plurality of bubble rings is wiped across the wiping element and then positioned in front of the fan to receive air blown by the fan.

9 Claims, 12 Drawing Sheets

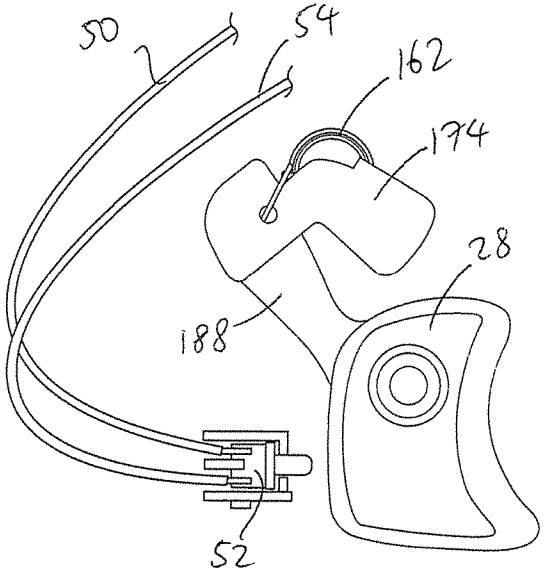
FIG.19
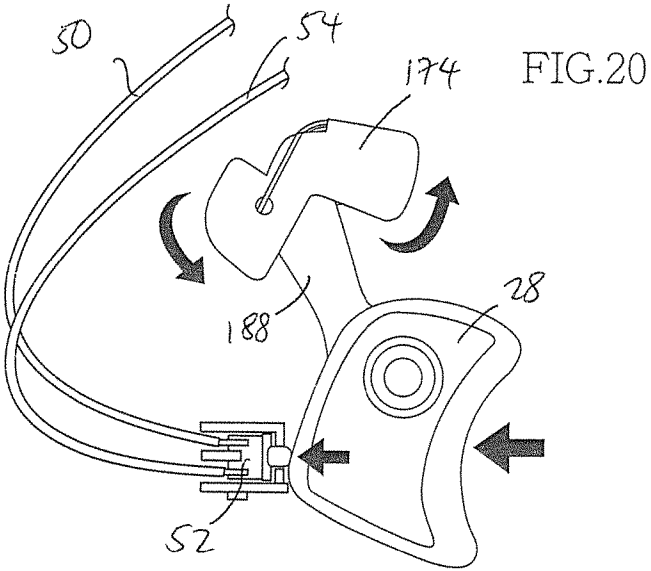
FIG.20
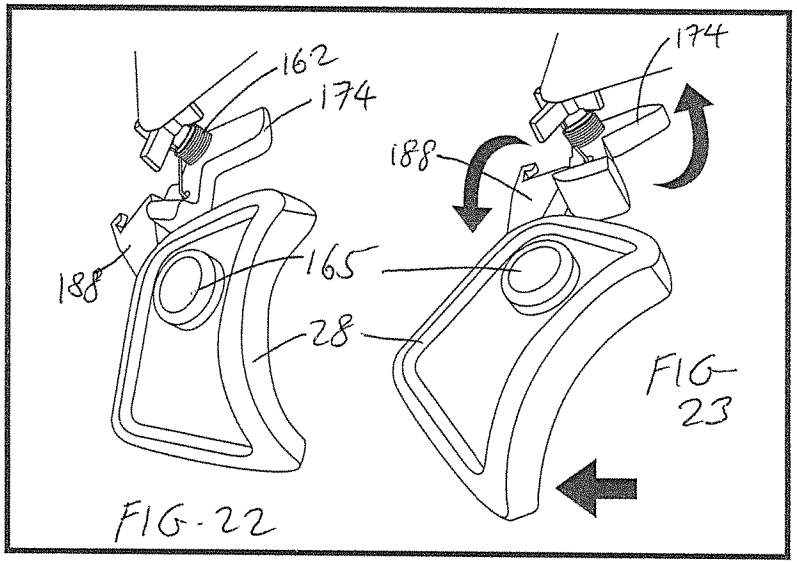
FIG. 22
FIG 23

BUBBLE GENERATING APPARATUS

BACKGROUND OF THE INVENTION

1. Field of the Invention

The present invention relates to bubble toys, and in particular, to a bubble generating assembly configured as a bubble gun and which generates a continuous stream of bubbles.

2. Description of the Prior Art

Bubble producing toys are very popular among children who enjoy producing bubbles of different shapes and sizes. Many bubble producing toys have previously been provided. Perhaps the simplest example has a stick with a circular opening or ring at one end, resembling a wand. A bubble solution film is produced when the ring is dipped into a dish that holds bubble solution or bubble producing fluid (such as soap) and then removed therefrom. Bubbles are then formed by blowing carefully against the film. Such a toy requires dipping every time a bubble is to created, and the bubble solution must accompany the wand from one location to another.

Recently, the market has provided a number of different bubble generating assemblies that are capable of producing a plurality of bubbles. Examples of such assemblies are illustrated in U.S. Pat. No. 6,149,486 (Thai), U.S. Pat. No. 6,331,130 (Thai) and U.S. Pat. No. 6,200,184 (Rich et al.). The bubble rings in the bubble generating assemblies in U.S. Pat. No. 6,149,486 (Thai), U.S. Pat. No. 6,331,130 (Thai) and U.S. Pat. No. 6,200,184 (Rich et al.) need to be dipped into a dish that holds bubble solution to produce films of bubble solution across the rings. The motors in these assemblies are then actuated to generate air against the films to produce bubbles.

All of these aforementioned bubble generating assemblies require that one or more bubble rings be dipped into a dish of bubble solution. In particular, the child must initially pour bubble solution into the dish, then replenish the solution in the dish as the solution is being used up. After play has been completed, the child must then pour the remaining solution from the dish back into the original bubble solution container. Unfortunately, this continuous pouring and re-pouring of bubble solution from the bottle to the dish, and from the dish back to the bottle, often results in unintended spillage, which can be messy, dirty, and a waste of bubble solution.

In response to these deficiencies, new bubble generating assemblies were provided in U.S. Pat. No. 6,682,570 (Thai), U.S. Pat. No. 7,367,861 (Thai) and U.S. Pat. No. 8,123,584 (Thai) which automatically formed a bubble film over a bubble ring without the need to dip the bubble ring into a container or a dish of bubble solution. However, the number and nature of the generated bubbles were limited. For example, these assemblies could not generate a large quantity of bubbles, and usually could only generate bubbles of the same size.

Thus, there remains a need to provide an apparatus and method for forming a film of bubble solution across a bubble ring without the need to dip the bubble ring into a dish of bubble solution, and which provides greater variety in play and entertainment.

SUMMARY OF THE DISCLOSURE

In order to accomplish the objects of the present invention, there is provided a bubble generating device having a housing having a front opening, with a bubble generating assembly and a solution collection region positioned adjacent the front opening. The bubble generating assembly has a support frame having a stationary wiping element, the wiping element having an opening through which bubble solution leaks out. The bubble generating assembly also has a support ring and a plurality of bubble rings provided on the support ring, with the support ring coupled to the support frame for rotation in a manner where each of the plurality of bubble rings individually wipes across the wiping element at the location of the opening. A motor is positioned inside the housing and has a fan that is directed to blow air towards the front opening. A container is coupled to the housing and retains bubble solution. A tubing couples the interior of the container with the wiping element. A pump system is coupled to the motor, and is actuated by the trigger, to deliver bubble solution from the interior of the container through the tubing and to the wiping element. A link assembly couples the motor and the support ring in a manner in which actuation of the trigger causes the support ring to be rotated so that each of the plurality of bubble rings is wiped across the wiping element and then positioned in front of the fan to receive air blown by the fan.

BRIEF DESCRIPTION OF THE DRAWINGS

FIGS. 15B-15E illustrate how the pump system of FIG. 15A operates.

FIGS. 19 and 20 illustrate how the actuation of the trigger pivots the pivot member and closes the electrical contact.

FIGS. 22 and 23 are reverse views of FIGS. 19 and 20, respectively, illustrating how the actuation of the trigger pivots the pivot member.

DETAILED DESCRIPTION OF THE PREFERRED EMBODIMENTS

Figure 1:
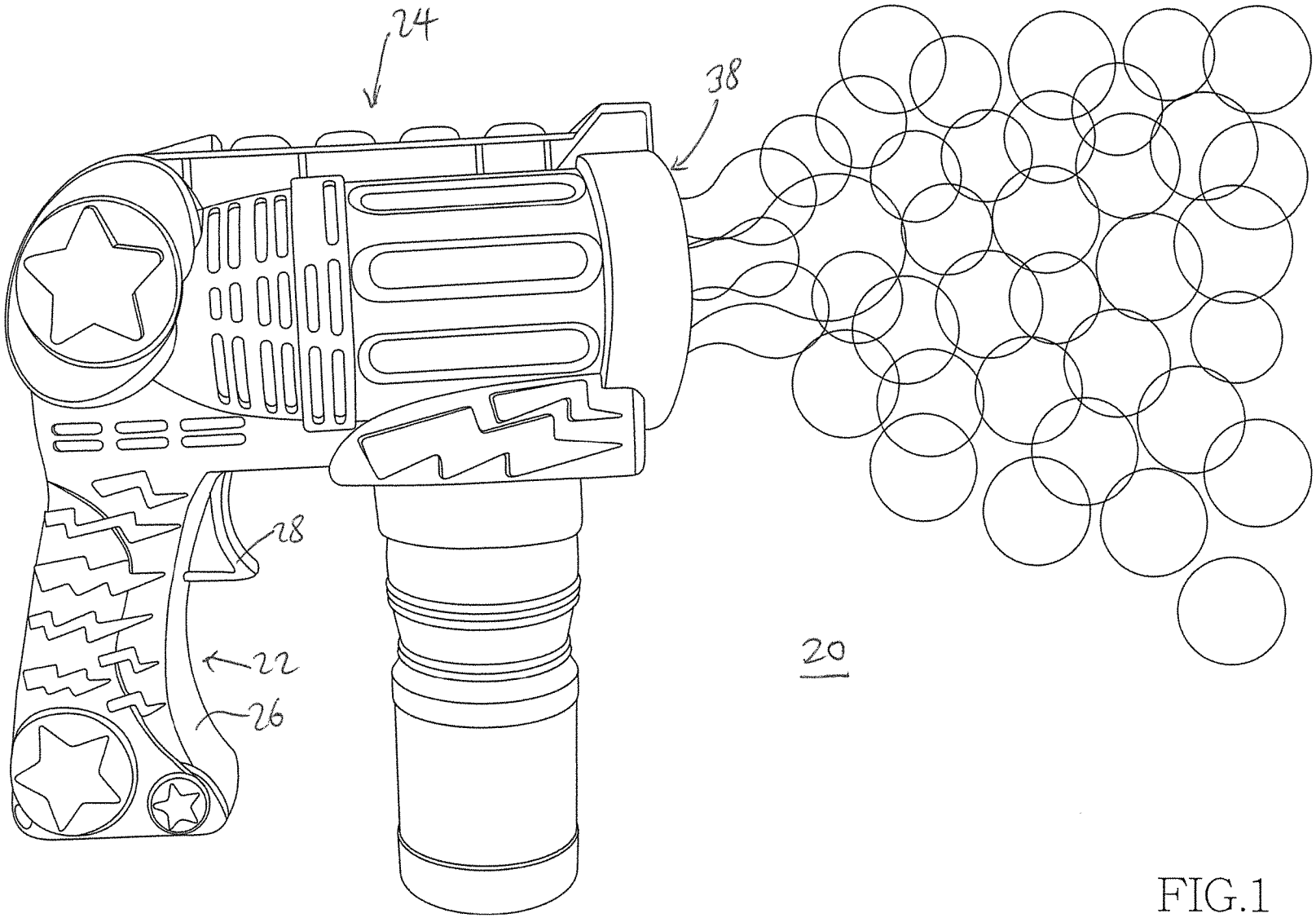
FIG. 1 is a side view of a bubble generating assembly or device according to one embodiment of the present invention.
Figure 3:
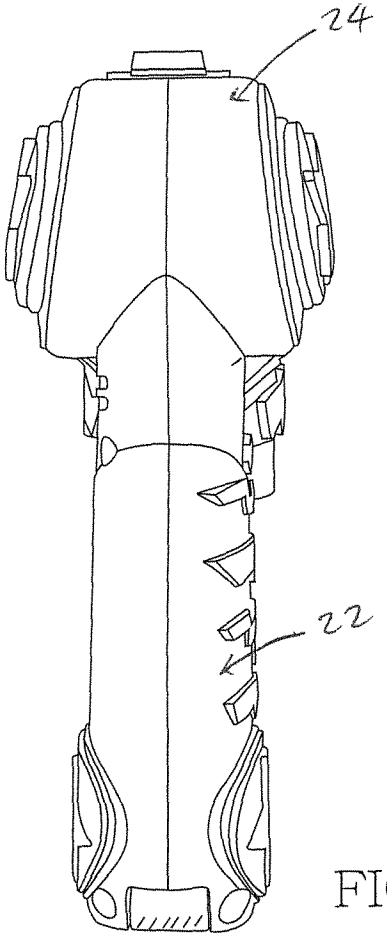
FIG. 3 is a rear view of the assembly of FIG. 1.
Figure 2:
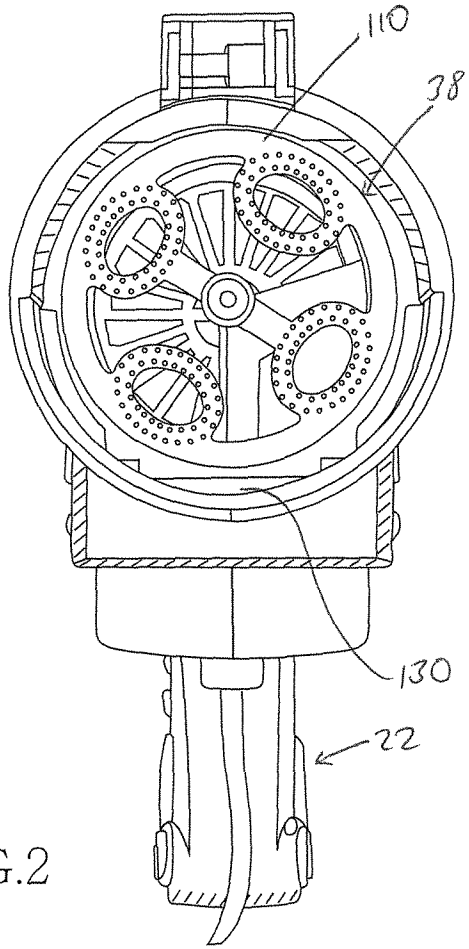
FIG. 2 is a front view of the assembly of FIG. 1.
Figure 6:
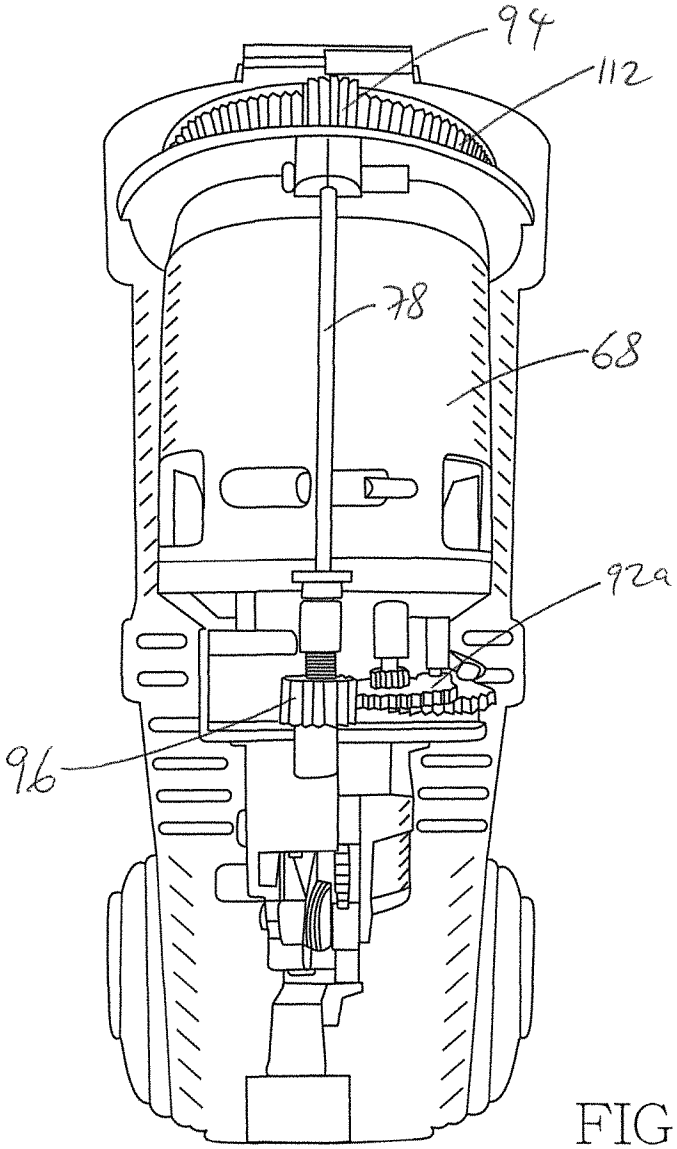
FIG. 6 is a top view of the assembly of FIG. 1 shown with the top housing removed.
Figure 5:
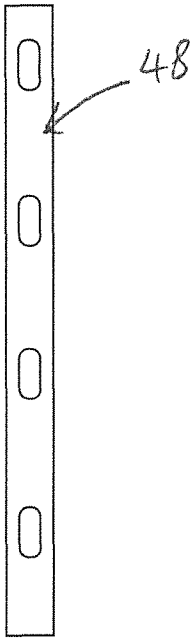
FIG. 5 illustrates the row of LED lights for the assembly of FIG. 1.
Figure 4:
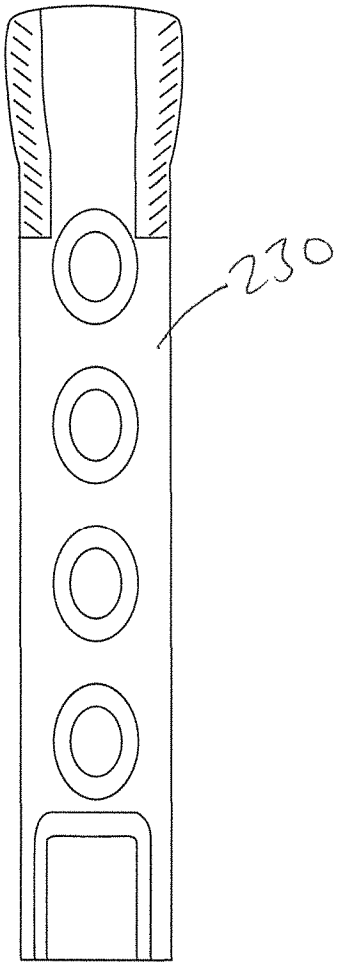
FIG. 4 is a top view of the assembly of FIG. 1.

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

The present invention provides a bubble generating assembly that can, upon actuating a first trigger, generate a stream of bubbles without the need to manually dip a bubble ring into bubble solution.

FIGS. 1-20 illustrate one embodiment of a bubble generating assembly or device 20 according to the present invention. The assembly 20 has a housing that includes a handle section 22 and a barrel section 24. The housing can be provided in the form of two symmetrical outer shells that are connected together by, for example, screws or welding or glue. These outer shells together define a hollow interior for housing the internal components of the assembly 20, as described below. The handle section 22 has an inner surface 26 that can be gripped by the hand of a user, and a trigger 28 extending from the inner surface 26 adjacent the top of the handle section 22.

Figure 8:
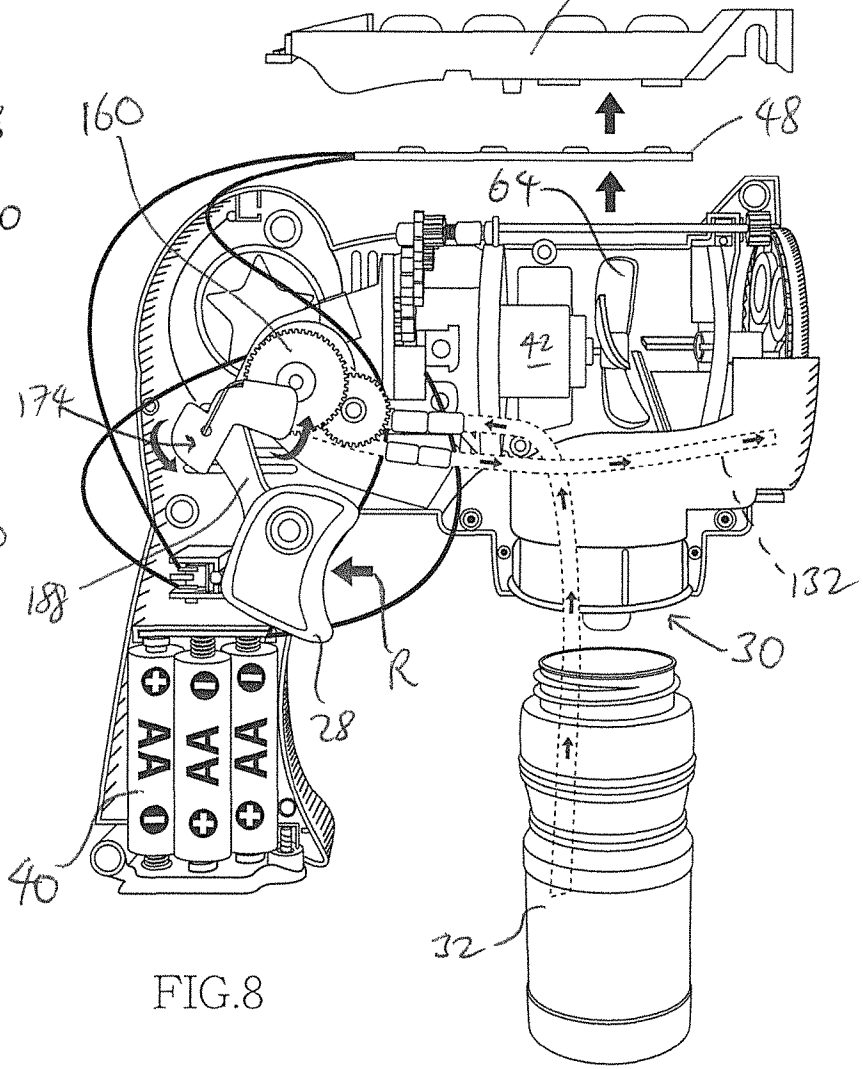
FIG. 8 is a side view of the assembly of FIG. 1 shown with the housing removed, with the trigger actuated.
Figure 7:
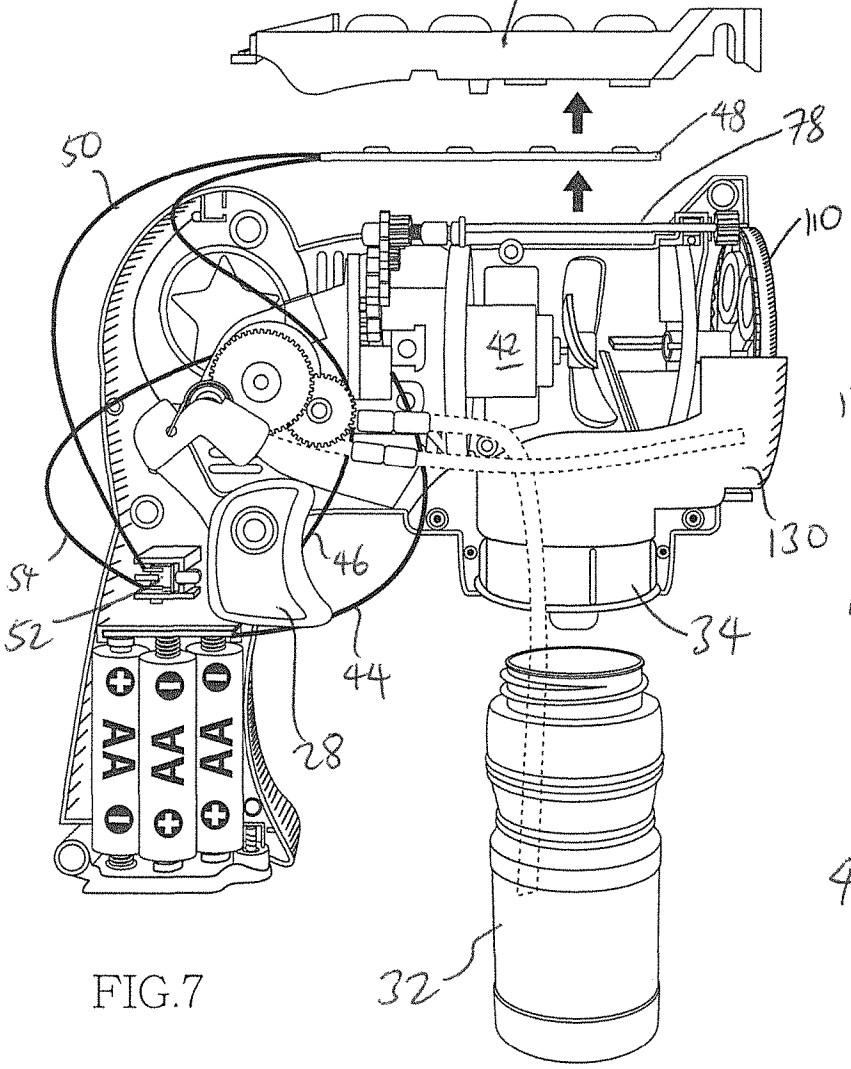
FIG. 7 is a side view of the assembly of FIG. 1 shown with the housing removed, with the trigger in the stationary position.
Figures 9, 10:
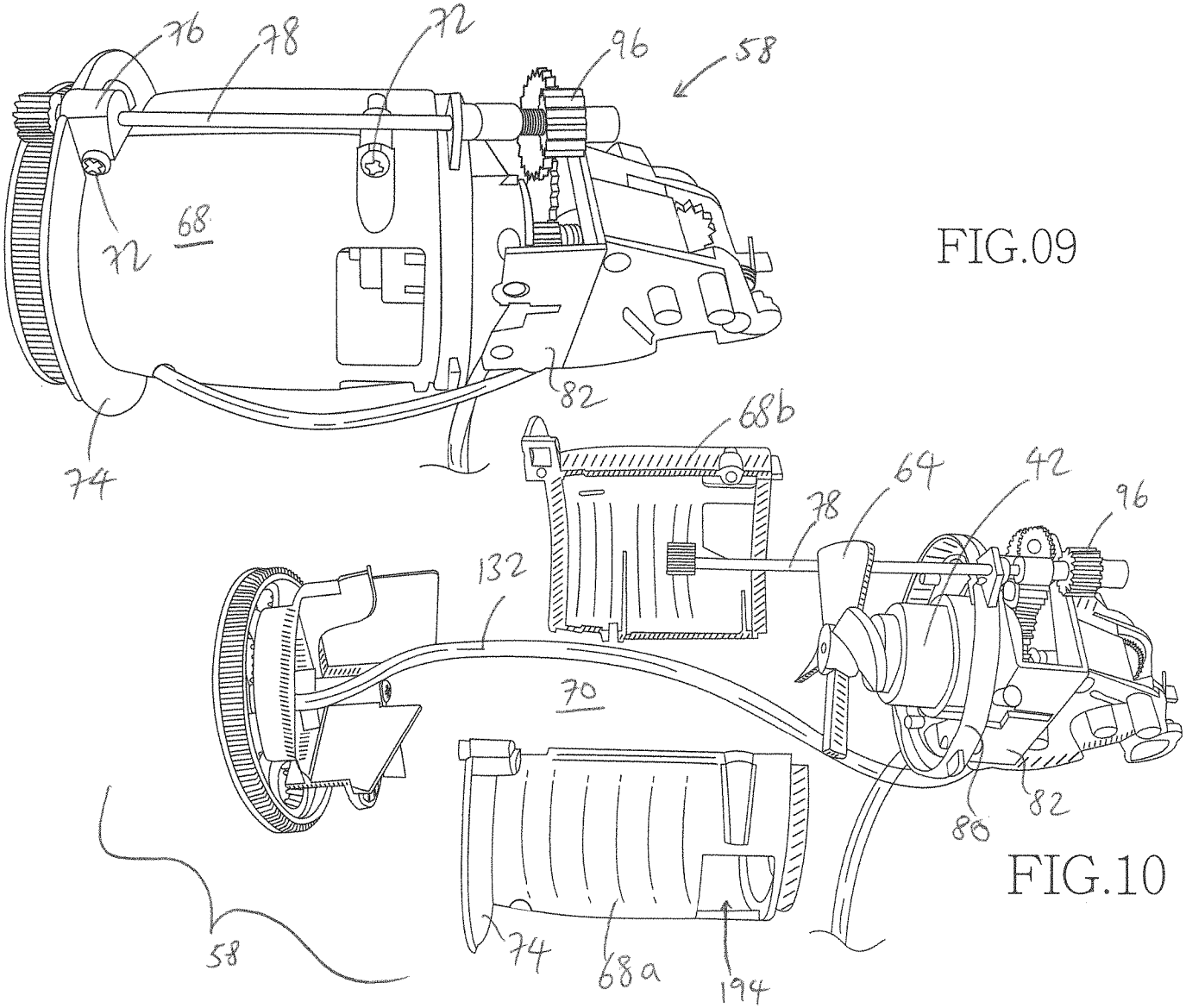
FIG. 9 is a perspective view of the inner housing and the drive system of the assembly of FIG. 1.
FIG. 10 is an exploded view of FIG. 9 with the two shells of the inner housing exploded.
Figure 11:
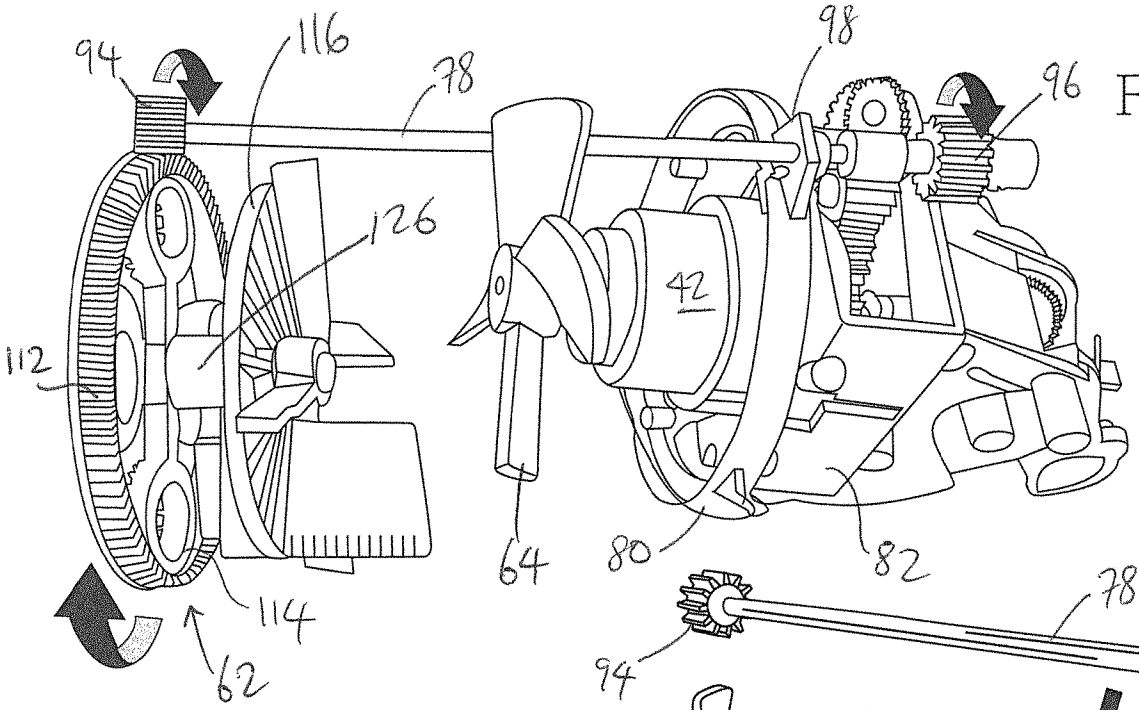
FIG. 11 is an isolated and enlarged perspective view of the link system of the assembly of FIGS. 1 and 9.
Figure 12:
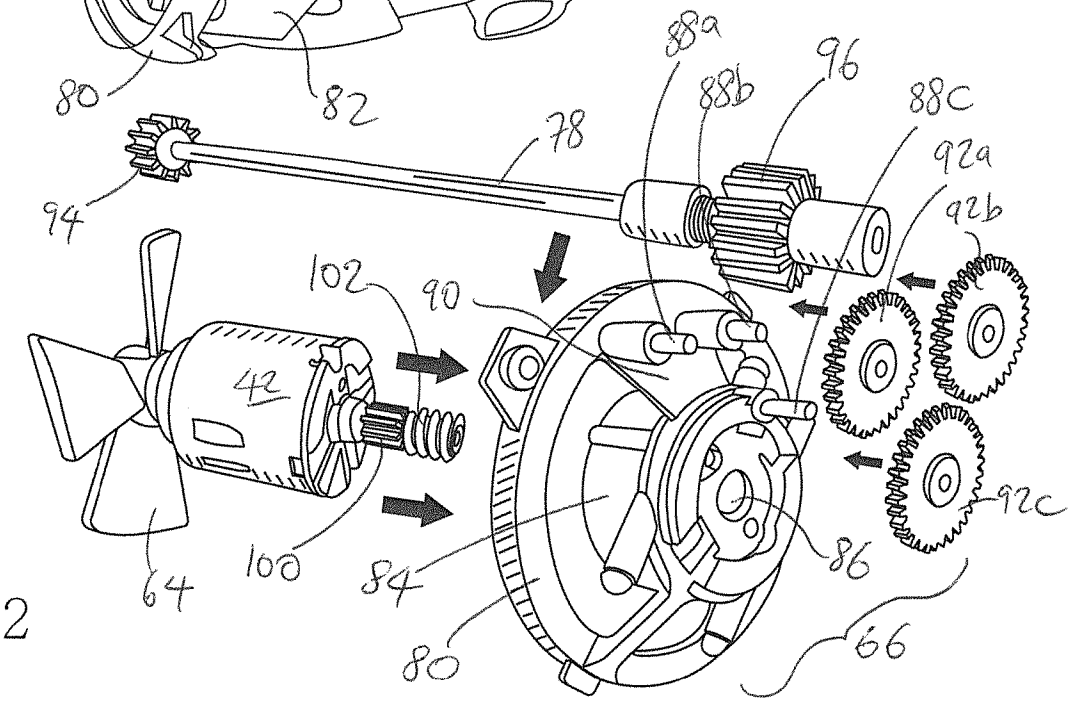
FIG. 12 is an exploded perspective view of some of the components of FIG. 11.
Figure 16:
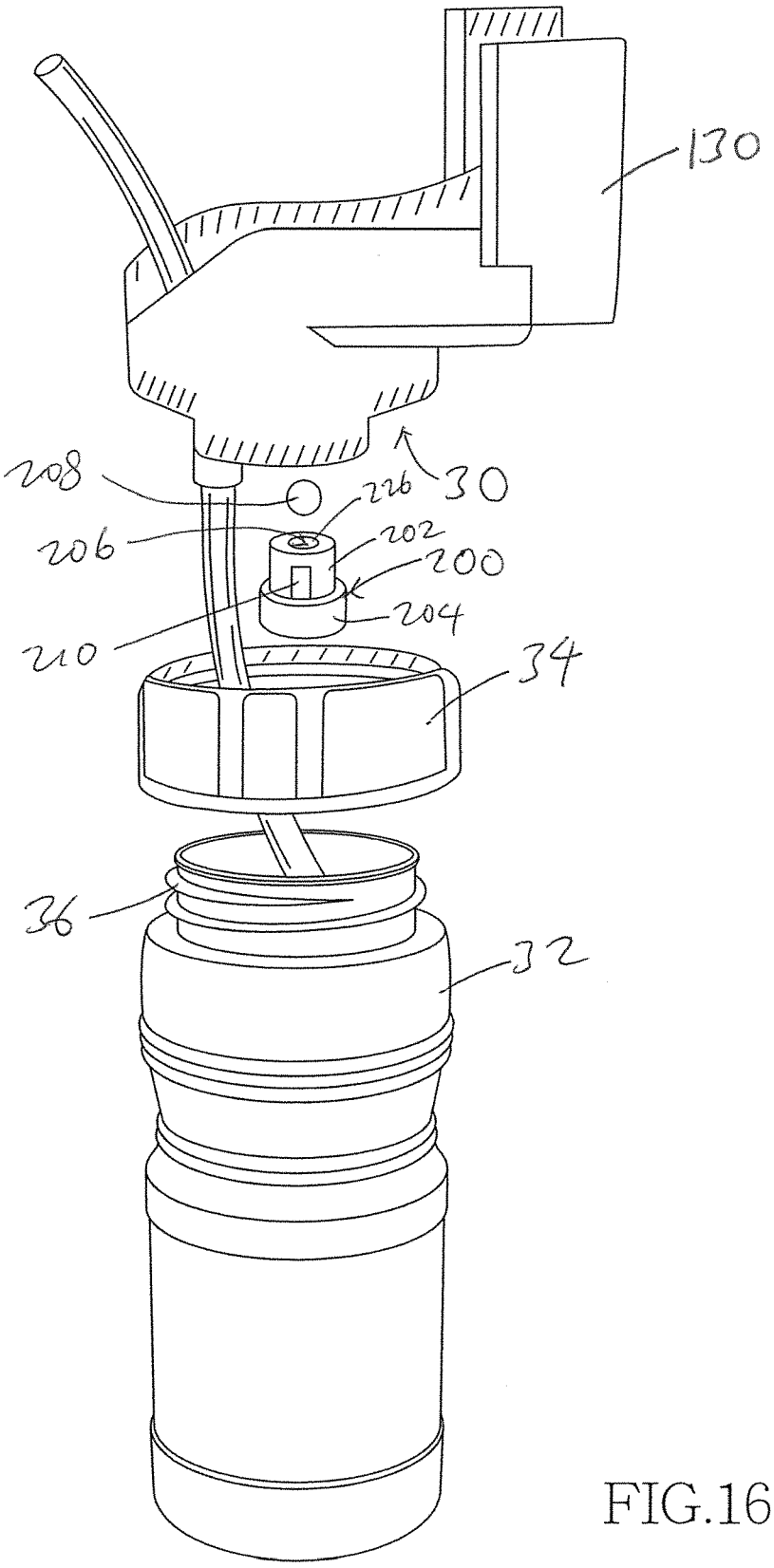
FIG. 16 is an exploded perspective view of the bubble solution container being coupled to the housing.

Referring to FIGS. 7, 8 and 16, the lower front portion of the barrel section 24 defines a first receiving space 30 that removably couples a conventional bubble solution bottle 32. The bubble solution bottle 32 can be provided in the form of any of the conventional bubble solution containers that are currently available in the marketplace. The receiving space 30 is defined by a cap-like connector 34 which has internal threads that are adapted to releasably engage the external threads 36 on the neck of the bottle 32. In addition, a front opening 38 (see FIG. 1) is provided at the front of the barrel section 24.

Referring to FIGS. 7 and 8, the handle section 22 houses a power source 40 which can include at least one conventional battery. A motor 42 is part of a drive system 58 (see FIGS. 9-12) that is secured inside the housing at the barrel section 24, and the motor 42 is electrically coupled to the power source 40 via a first wire 44. A second wire 46 electrically couples the power source 44 to an LED light panel 48, and a third wire 50 electrically couples the LED light panel 48 to an electrical contact 52. A fourth wire 54 electrically couples the contact 52 to the motor 42. The electrical contact 52 is adapted to releasably contact the trigger 28.

A pump system 60 (described in greater detail below in connection with FIGS. 15A and 15B) is secured inside the housing at a position adjacent the trigger 28 and the motor 42, and is operatively coupled to the motor 42 to deliver bubble solution from the bottle 32 to the bubble generating assembly 62.

The drive system 58 is best shown in connection with FIGS. 6-12, and operates to actuate the motor 42 to simultaneously: (i) drive a link system (see FIGS. 11-12) to cause a bubble generating assembly 62 to rotate, (ii) cause the pump system 60 to deliver bubble solution from the bottle 32 to the bubble generating assembly 62, and (iii) drive a fan 64 to blow air towards the bubble generating assembly 62.

The drive system 58 includes the motor 42, the fan 64, a link system 66, and a drive housing 68 that encloses and defines an air channel 70 for directing air generated by the fan 64 to the bubble generating assembly 62. The drive housing 68 can be comprised of two shells 68*a* and 68*b* that are sealed together by screws 72. One end of the drive housing 68 has an annular flange 74 which surrounds the hub 126 (see discussion below) of the bubble generating assembly 62. A support hub 76 is provided at the top of the flange 74 and has a bore through which a link rod 78 extends.

The link system 66 has a generally annular motor support 80 that is secured to a gear bracket 82. The motor support 80 has a central hub 84 that has a bore 86 extending therethrough, with the hub 84 extending inside the gear bracket 82. Three gear shafts 88*a*, 88*b* and 88*c* are provided on a rear surface 90 of the motor support 80, are retained inside the gear bracket 82, and are each adapted to receive a separate gear 92*a*, 92*b* and 92*c*, respectively. The link rod 78 has a first ribbed wheel 94 at a front end, and a second ribbed wheel 96 adjacent its rear end. The link rod 78 is received inside a positioning bracket 98, which is located on top of the motor support 80. The ribs on the wheel 96 engage the teeth on the gear 92*a*. The motor 42 carries the fan 64 on its front end, and has a drive shaft that includes a ribbed gear 100 and a coiled gear 102. The drive shaft extends through the bore 86, and the ribs on the ribbed gear 100 engage the teeth on the gear 92*c*. As a result, the rotation of the ribbed gear 100 causes the gears 92*a*, 92*b* and 92*c* to rotate, with the rotation being translated to cause the wheel 96 to rotate, which in turn causes the wheel 94 to rotate.

Referring to FIGS. 11-14 and 21, the bubble generating assembly 62 has an annular support ring 110 that has a ribbed circumferential surface 112. A plurality of bubble rings 114 are provided in spaced-apart manner around the circumference of the support ring 110. Even though FIGS. 11-14 illustrate the provision of four bubble rings 114, any number of bubble rings 114 can be provided. Serrated lines 120 and dimples 122 can be provided along the front surface 124 of the support ring 110 to aid in the formation of bubbles as the bubble solution tends to cling more effectively to uneven surfaces. The bubble rings 114 can be circular or oval.

Figure 14:
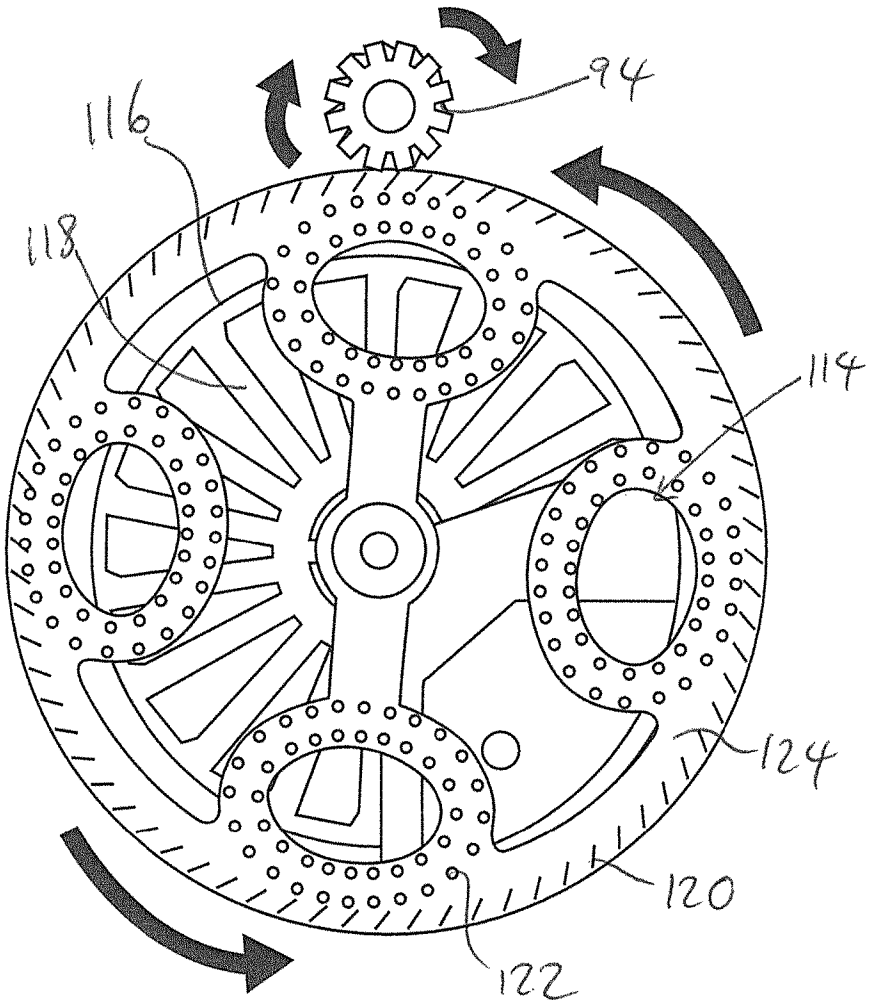
FIGS. 13 and 14 illustrate how the bubble generating assembly is rotated.
Figure 13:
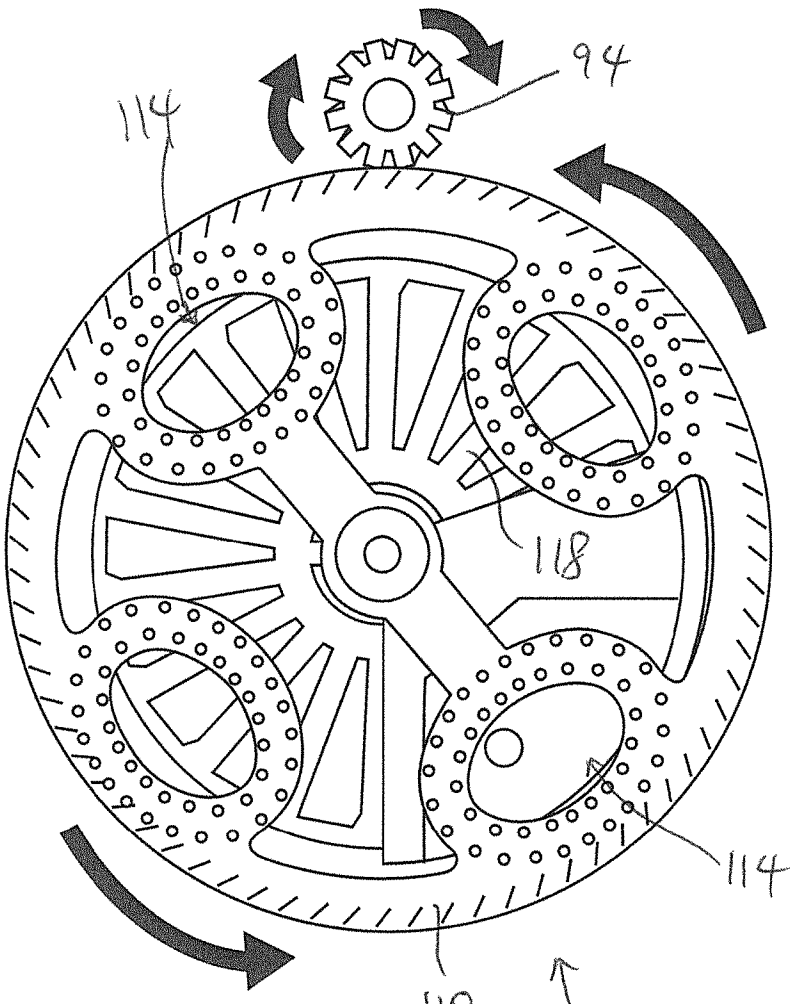

A support frame 116 extends rearwardly from the support ring 110 via a hub 126, and has a plurality of spokes 118. The support frame 116 is secured at the flange 74 so that the support frame 116 is stationary and cannot move. The support ring 110 has a shaft 119 which is received inside the hub 126 and which is rotatable about the hub 126. The ribs on the wheel 94 engage the ribs on the circumferential surface 112, so that rotation of the rod 78 and its wheel 94 will cause the support ring 110 to rotate. FIGS. 13 and 14 illustrate the rotation of the support ring 110 through two different positions to generate a bubble film on the bubble rings 114.

A stationary wiping element 125 is provided on a part of the support frame 116, and can be configured in the form of a block or housing with a hollow interior and a flat or planar front face 129. The wiping element 125 is positioned between the support frame 116 and the support ring 110. The tubing 132 extends into the wiping element 125, and the wiping element 125 has an opening 127 on its front face 129 through which bubble solution can leak out. As the support ring 110 rotates about the support frame 116, individual bubble rings 114 will wipe across the front face 129 to create a bubble film across the bubble ring 114.

Figure 17:
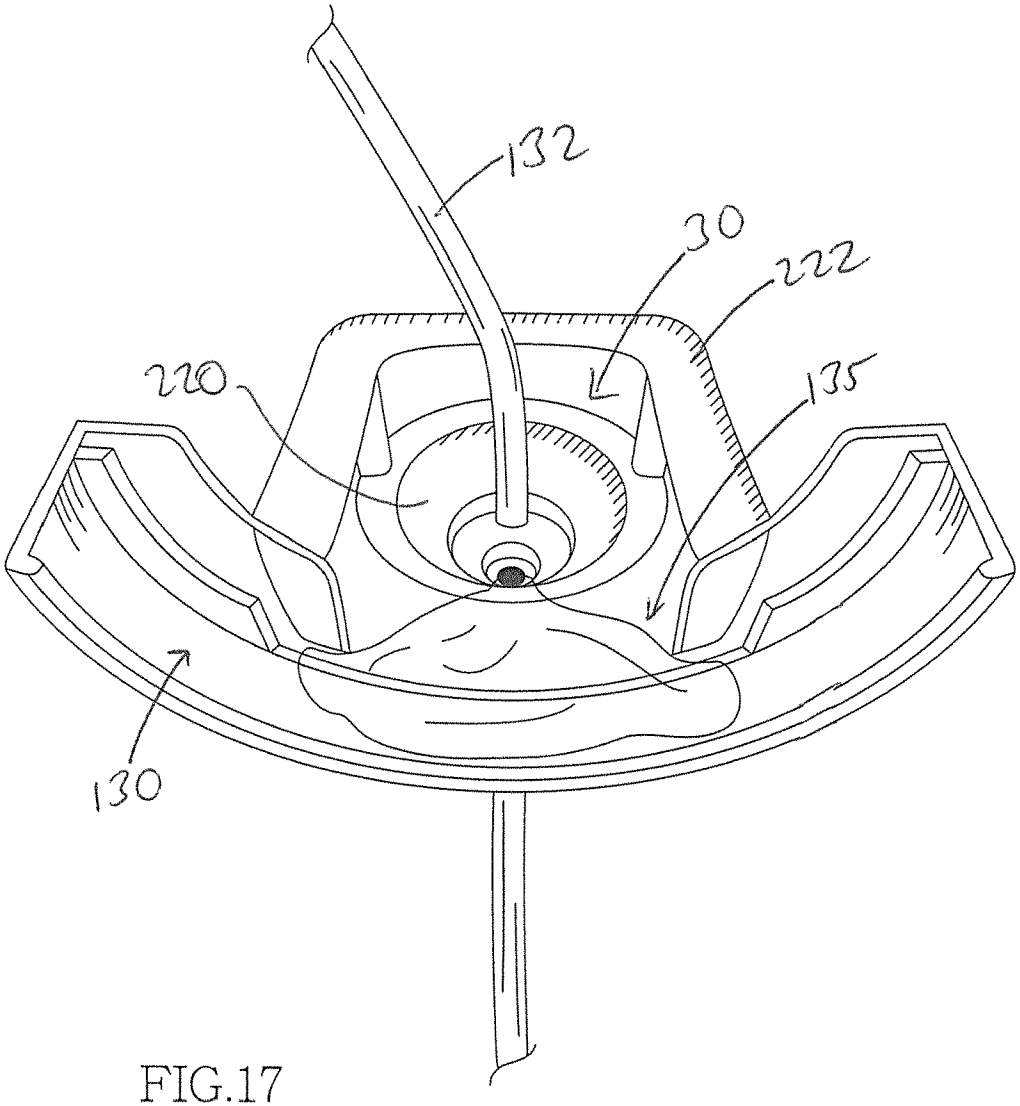
FIG. 17 illustrates the solution collection region.
Figure 21:
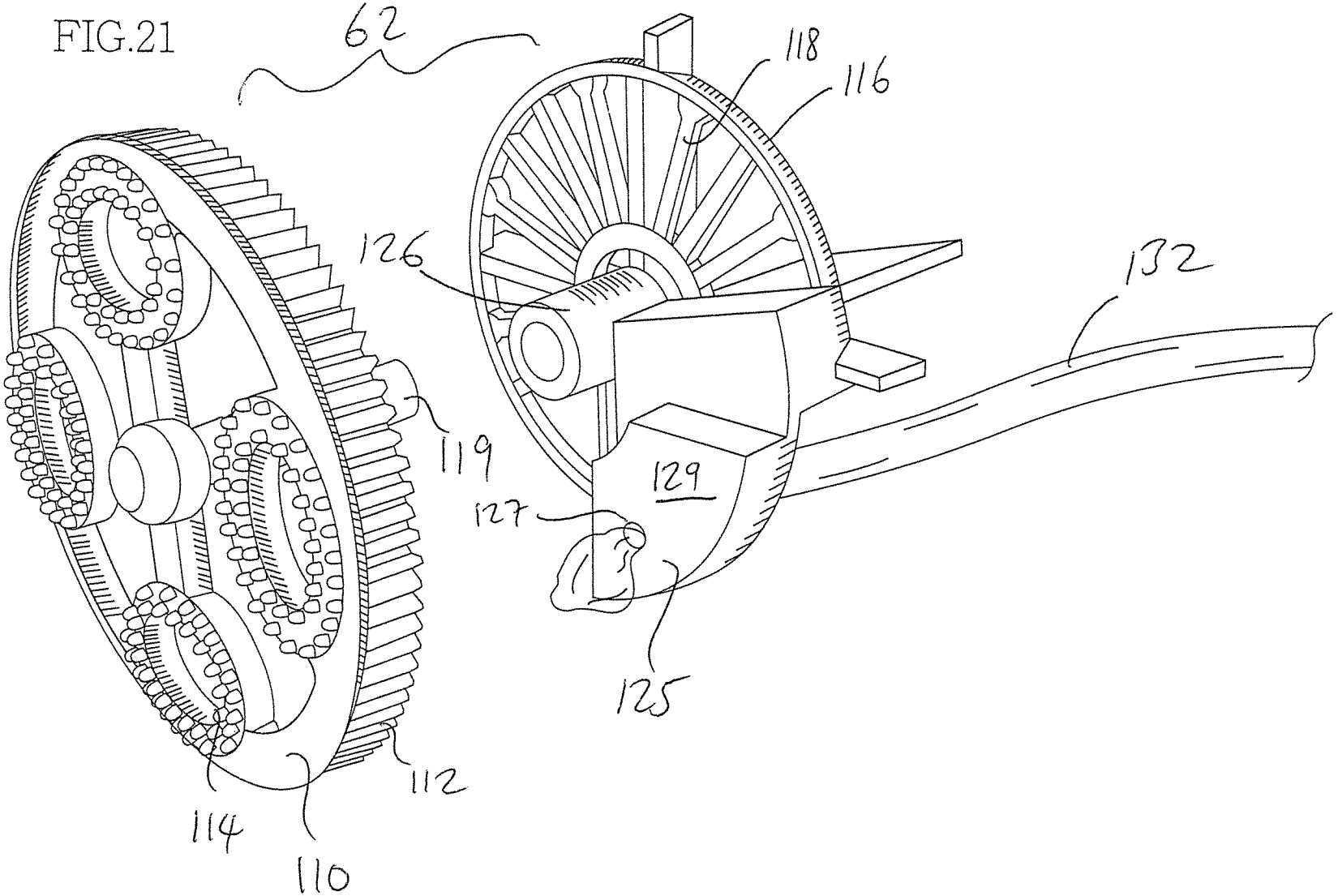
FIG. 21 is an exploded perspective view of the bubble generating assembly.

Referring to FIGS. 2, 7, 8 and 16-18, the front end of the barrel section 24 adjacent the front opening 38 defines a solution collection region 130 where bubble solution that drips from the bubble rings 114 is collected. As best shown in FIG. 17, the solution collection region 130 is a generally curved receptacle that extends forwardly from the receiving space 30, with an opening 135 separating the receptacle of the solution collection region 130 from the enclosure 222 for a collection funnel 220.

Referring now to FIGS. 7, 8 and 15A-15E, the assembly 20 includes a pump system 60 that functions to pump the bubble solution from the solution bottle 32 to the bubble generating assembly 62. The pump system includes the motor 42, the tubing 132, an upper housing plate 134, a lower housing plate 136 having a guide wall 138, and a gear system that functions to draw bubble solution through the tubing 132. The gear system includes the coiled gear 102 is rotatably coupled to the drive shaft of the motor 42, a first pump gear 158, a second pump gear 160, a resilient element 162 (such as a spring), two pushers 164 and 166, a shaft 168, and a pivot member 174. The coiled gear 102 engages the teeth of the first pump gear 158. The first pump gear 158 is rotatably coupled to the housing plates 134 and 136 via a shaft 148, and has teeth that are engaged with the teeth of the second pump gear 160. The second pump gear 160 rotates about an axis defined by another shaft 146, and has a ring piece 190 positioned along the shaft 146 above the gear. The pushers 164, 166 are secured to the bottom side of the second pump gear 160. Each pusher 164, 166 has a frusto-conical configuration (i.e., like a truncated cone), with a larger diameter at its connection with the second pump gear 160, and with its diameter gradually decreasing to its free end 144.

Figure 15A:
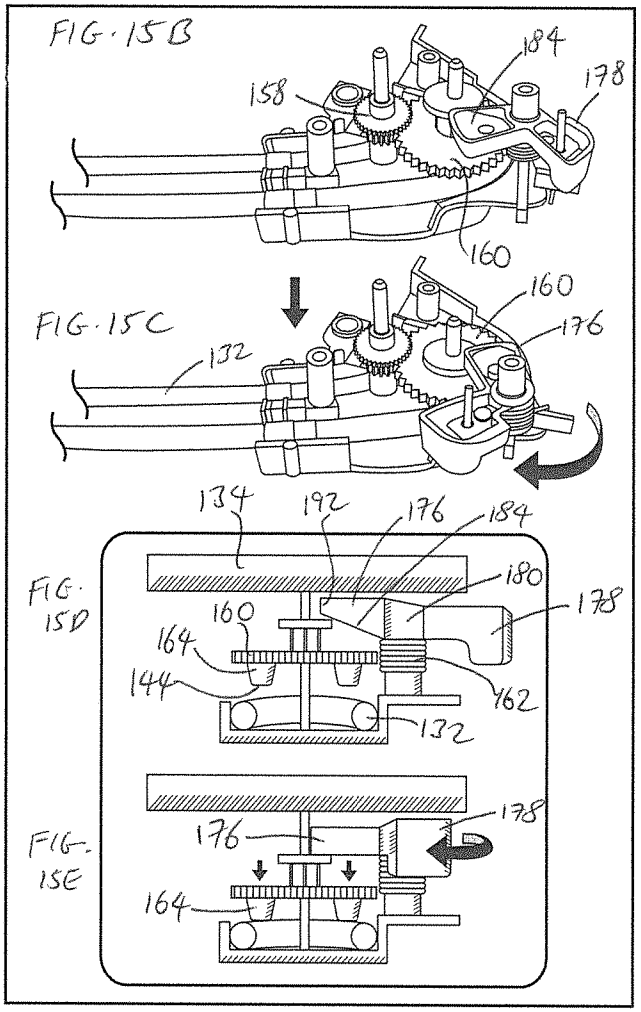
FIG. 15A is an exploded perspective view of the pump system of the assembly of FIG. 1.
Figure 15A:
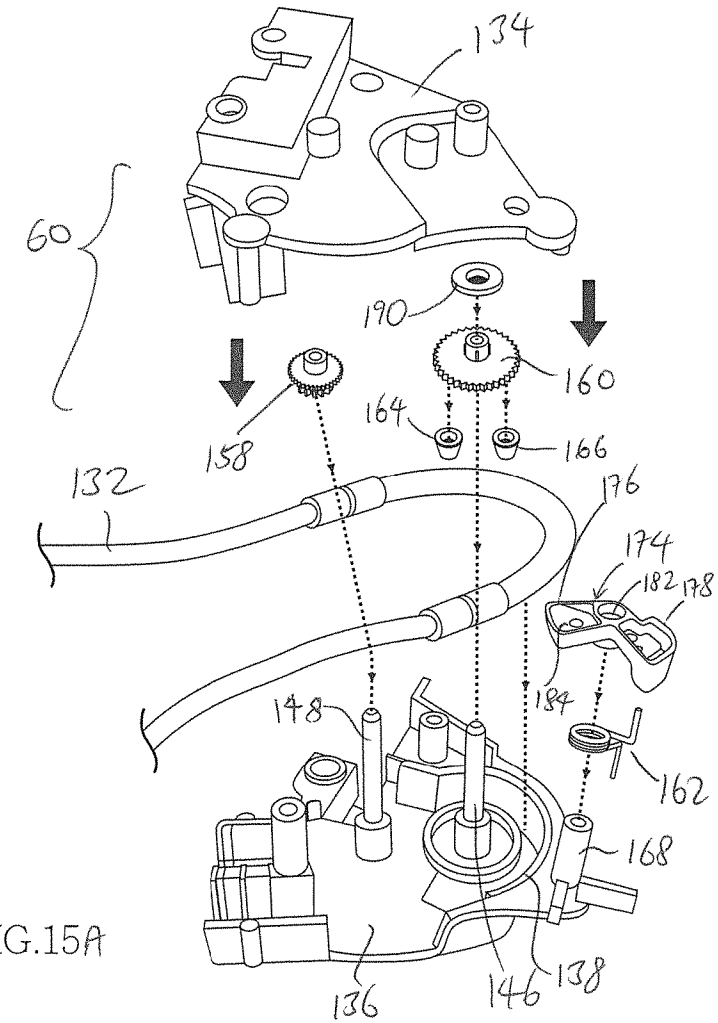

The pivot member 174 is generally L-shaped and has two arms 176 and 178 extending in an angled manner from a central base 180 which has an opening 182. The spring 162 is coiled around the shaft 168, which is positioned adjacent the guide wall 138 on the lower housing plate 136. The shaft 168 also extends through the opening 182 so that the pivot member 174 sits on top of the spring 162. Referring to FIGS. 15A, 15D and 15E, the arm 176 has a ramped surface 184 which extends from the central base 180 in a manner such that the thickness of the arm 176 gradually decreases from the central base 180 towards the end 192 of the arm 176. FIGS. 15B and 15D illustrate the pump system 60 in the normal (non-bubble generating) position, where the end 192 of the arm 176 is above the ring piece 190 and not exerting any downward force on the ring piece 190 or the second pump gear 160. FIGS. 15C and 15E illustrate the pump system 60 being actuated, where the thicker portion of the arm 176 is applying a downward force on the ring piece 190 and the second pump gear 160.

Thus, the pivot member 174 can be pivoted with respect to the stationary guide wall 138 and lower housing plate 136 about an axis defined by the shaft 168, with the spring 162 functioning to normally bias the pivot member 174 in a counter-clockwise direction (as viewed from the orientation in FIG. 15B) to a first normal position that is shown in FIGS. 15B and 15D. In this normal position, the ring piece 190 is below, and not contacted by, the end 192 of the pivot member 174, where the thickness of the arm 176 is smallest. In addition, the tubing 132 extends from the interior of the solution bottle 32, through the connector 34, into the housing, and passes through a path (that is defined by the pushers 164 and 166, and the guide wall 138) that leads to the bubble generating assembly 62.

Referring to FIGS. 22-23, a link piece 188 pivotably connects the trigger 28 to the pivot member 174. The link piece 188 can be an extension of the trigger 28. When the trigger 28 is pressed (see FIG. 8), the trigger 28 contacts the electrical contact 52 to close the circuit, thereby actuating the motor 42. The coiled gear 102 will rotate, thereby causing the first and second pump gears 158 and 160 to rotate as well. As the second pump gear 160 rotates, the pushers 164 and 166 will also rotate about the shaft 146. In addition, when the trigger 28 is pressed, the trigger 28 pivots about a pivot point 165 so that the link piece 188 pushes the pivot member 174 to overcome the bias of the spring 162, causing the pivot member 174 to pivot clock-wise (as viewed from the orientation of FIG. 15C) from the position shown in FIG. 15B and FIG. 15D to the position shown in FIGS. 15C and 15E. This causes the arm 176 to push down on the ring piece 190 and the second pump gear 160, thereby causing the pushers 164 and 166 to press down on the tubing 132.

A fan system is illustrated in FIGS. 7-12. The fan 64 is provided inside the drive housing 68, and is rotatably coupled to the motor 42. An opening 194 is provided in the drive housing 68 to allow air from the external environment to be directed into the air channel 70, so that the fan 64 can direct the air as a stream of air through the length of the air channel 70 to the front opening 38 where the bubble generating assembly 62 is located. The stream of air can be blown against the bubble rings 114 to generate bubbles.

Figure 18:
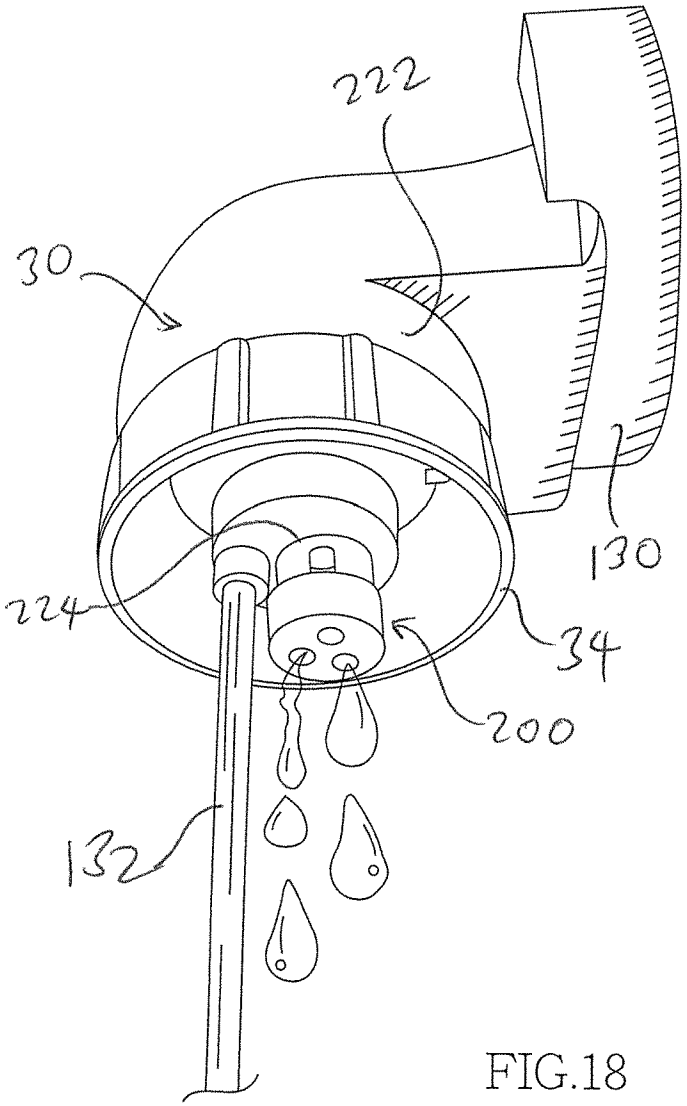
FIG. 18 illustrates the receiving space of the housing.

Referring to FIGS. 16-18, a collection funnel 220 is positioned inside the enclosure 222 and above the connector 34. The collection funnel 220 can collect and receive droplets of bubble solution that have dripped from the bubble rings 114 into the solution collection region 130 (which communicates with the collection funnel 220), and deliver these droplets of bubble solution back into the interior of the solution bottle 32. The cap-like connector 34 is fixedly secured to the housing at a location below the collection funnel 220. The bottle 32 can be threadably connected to, and disengaged from, the connector 34. The connector 34 has a first opening through which the tubing 132 extends, and a second opening 24 that retains a valve element 200. The valve element 200 has a cylindrical body 202 with a shoulder 204 at its lower end. A bore 206 extends through the cylindrical body 202, and a ball 208 is retained inside the bore 206. The bottom wall of the cylindrical body 202 has an elongated slit 210 which has a width that is smaller than the diameter of the ball 208. Therefore, the ball 208 cannot pass through the slit 210, but can only be seated against the slit 210 in a manner that partially, but not completely, blocks the slit 210. The upper end of the cylindrical body 202 is attached to the second opening 224. In addition, the diameter of the opening 226 at the top of the bore 206 is smaller than the diameter of the ball 208, so that the ball 208 cannot pass through the opening 226 to the interior of the collection funnel 220. Thus, when the assembly 20 is oriented in the orientation shown in FIG. 1, the ball 208 will be seated at the bottom of the bore 206 against the slit 210, thereby allowing bubble solution collected by the collection funnel 220 to flow through the opening 226, the bore 206, and the portions of slit 210 that are not blocked by the ball 208, back into the solution container 32. On the other hand, if the assembly 20 is inverted (i.e., turned upside down), the ball 208 will be abutted against the opening 226, and will completely block the opening 226, so that bubble solution from the solution container 32 can flow through the slit 210 and the bore 206, but cannot be spilled through the second opening into the interior of the collection funnel 220.

An optional LED light panel 48 can be secured to the top of the drive housing 68, with a lens cover 230 secured on top of the LED light panel 48.

The assembly 20 operates in the following manner. In the normal (non-bubble-generating) position, which is illustrated in FIGS. 7, 15B and 15D, the spring 162 normally biases the pivot member 174 towards the normal position. At this time, the user can threadably secure the neck of the bottle 32 to the connector 34 so that the assembly 20 is ready for use.

The assembly 20 is actuated by pressing the trigger 28 in the direction of the arrow R in FIG. 8, which causes four sequences of events occur at about the same time.

First, bubble solution is pumped to the bubble generating assembly 62. In this regard, the rearward movement of the trigger 28 engages the electrical contact 52, thereby forming a closed electrical circuit that will deliver power from the power source 40 to the motor 42. The motor 42 will turn on, thereby causing the coiled gear 102 to drive and rotate the first and second pump gears 158 and 160. In addition, when the trigger 28 is pressed, the trigger 28 pushes the pivot member 174 (via the link piece 188) to overcome the bias of the spring 162, causing the pivot member 174 to pivot clock-wise (as viewed from the orientation of FIG. 15C) from the position shown in FIG. 15B and FIG. 15D to the position shown in FIGS. 15C and 15E. This causes the arm 176 to push down on the ring piece 190 and the second pump gear 160, thereby causing the pushers 164 and 166 to press down on the tubing 132 while they are rotating. As the pushers 164 and 166 rotate, they will apply selected pressure on different parts of the tubing 132. When the pushers 164 and 166 apply pressure on the tubing 132, the tubing 132 is compressed against the guide wall 138, thereby creating air pressure to draw the bubble solution from the interior of the solution bottle 32 through the tubing 132 to the wiping element 125.

This arrangement and structure of the pushers 164, 166 is effective in prolonging the useful life of the tubing 132 and the pump system 60. In particular, the pushers 164, 166 only apply pressure against the tubing 132 when the trigger 28 is pressed, so that the tubing 132 does not experience any pressure when the trigger 28 is not pressed. This is to be contrasted with conventional pump systems used for pumping bubble solution to a bubble producing device, where pressure is always applied to the tubing regardless of whether the trigger is actuated. Over a long period of time, this constant pressure will deform the tubing, making it difficult for bubble solution to be drawn through the tubing.

Second, the support ring 110 will be rotated. As best shown in FIGS. 7-14, when the trigger 28 is pressed in the direction of arrow R, the motor 42 actuates, resulting in rotation of the ribbed gear 100, which causes the gears 92*a*, 92*b* and 92*c* to rotate, with the rotation being translated to cause the wheel 96 to rotate, which in turn causes the wheel 94 to rotate. Since the wheel 94 is engaged with the ribbed circumferential surface 112, rotation of the wheel 94 will rotate the support ring 112. As the support ring 112 rotates, each bubble ring 114 will be wiped against the front face 129 of the wiping element 125, and a film of bubble solution will be generated across the opening of the bubble rings 114.

Third, the fan 64 that is secured to the motor 42 is turned on and blows a stream of air along the air channel 70 towards the bubble rings 114. This stream of air will then travel through the film of bubble solution that has been formed over each bubble ring 114, thereby creating bubbles. Since there is a plurality of bubble rings 114, the rotation of the support ring 110 positions each bubble ring 114 in front of the air channel 70 and then moves it away for another bubble ring 114 to be positioned in front of the air channel 70. As the support ring 112 is rotated, a large stream of bubbles will be generated. In addition, by varying the size and shape of the bubble rings 114, streams of bubbles having different shapes and sizes can also be produced.

Fourth, pressing the trigger 28 closes the electrical circuit and causes the LEDs on the LED light panel 48 to light up. The lights can be made to broadcast different effects, such as different colors, flashing, etc.

Thus, pressing the trigger 28 will create a film of bubble solution across the bubble rings 114 by (i) pumping bubble solution from the solution bottle 32 to the bubble generating assembly 62, and (ii) and causing the bubble rings 114 to be rotated past the wiping element 125 so that bubble films can be created across the bubble rings 114. Pressing the trigger 28 will also actuate the fan 64 to blow streams of air at the bubble rings 114 to create bubbles.

When the user releases his or her pressing grip on the trigger 28, the spring 162 will normally bias the trigger 28 back to the rest position (FIGS. 7, 15B and 15D), causing three events to occur.

First, this will cause the trigger 28 to be biased away from the contact 52 so that the electrical circuit is opened, thereby cutting power to the motor 42 and the LEDs. As a result, the fan 64 will stop producing streams of air and the LEDs will stop lighting up. This is the first event.

The second event is that the pump system 60 will stop drawing bubble solution from the solution bottle 32 to the wiping element 125. This occurs because power to the motor 42 has been cut so that the gears 102, 158 and 160 stop rotating. In addition, the spring 162 will bias the pivot member 174 in a counterclockwise direction (as viewed from the orientation of FIGS. 15B and 15C), so that the arm 176 stops applying downward pressure on to the ring piece 190, thereby releasing the pressure applied by the pushers 164, 166 on the tubing 132.

In the third event, the link system 66 will stop rotating the wheel 94, thereby stopping rotation of the support ring 112. When power to the motor 42 is cut, the ribbed gear 100 stops rotating, so that the other gears 92*a*, 92*b*, 92*c*, the wheel 96 and the link rod 78 all stop rotating.

In addition, the collection funnel 220 is fluidly connected with the solution collection region 130 to collect any stray droplets of bubble solution that drip from the bubble rings 114. These stray droplets can flow back into the solution bottle 32 via the collection funnel 220 and the valve element 200. In addition, the solution bottle 32 can be removed from the housing by threadably disengaging the neck of the solution bottle 32 from the connecting section 34, so as to replenish or replace the supply of bubble solution.

Thus, the present invention provides a bubble generating device or assembly 20 which generates a continuous stream of bubbles without needing to re-press the trigger. In prior art devices, the user would need to constantly re-press the trigger once the bubble film runs out. In contrast, the present invention provides a bubble generating assembly 62 that (i) has multiple bubble rings 114, and (ii) continually rotates these bubble rings 114, so that when the film runs out on the bubble ring, the next bubble ring would be wiping against the stationary wiping element 125 to generate additional films. Therefore, the user only needs to keep his/her finger on the trigger to generate continuous bubbles, instead of having to press and re-press the trigger.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A bubble generating device, comprising:

a housing having a front opening, with a bubble generating assembly and a solution collection region positioned adjacent the front opening, the bubble generating assembly having:

a support frame positioned adjacent the front opening and having a stationary wiping element, the wiping element having an opening through which bubble solution leaks out;

a support ring and a plurality of bubble rings provided on the support ring, with the support ring coupled to the support frame for rotation in a manner where each of the plurality of bubble rings individually wipes across the wiping element at the location of the opening;

a motor positioned inside the housing and having a fan that is directed to blow air towards the front opening and the support ring;

a container coupled to the housing and retaining bubble solution, the container having an interior;

a trigger provided on the housing;

a tubing that extends inside the housing and which couples the interior of the container with the wiping element;

a pump system inside the housing and coupled to the motor and including at least one gear that includes a first gear having a plurality of pushers, the first gear is rotatably coupled to the motor, and a pivot member that is pivotably coupled to the trigger, the pivot member having a ramped surface, wherein the pump system is normally in a non-bubble-generating position where the ramped surface does not press down on the first gear, and wherein pressing the trigger causes the ramped surface of the pivot member to press down on the first gear to cause the pushers to rotatably apply pressure to the tubing thereby creating air pressure to draw bubble solution from the interior of the container through the tubing and to the wiping element; and a link assembly positioned inside the housing that couples the motor and the support ring in a manner in which actuation of the trigger causes the support ring to be rotated so that each of the plurality of bubble rings is wiped across the wiping element and then positioned in front of the fan to receive air blown by the fan.

2. The device of claim 1, wherein the support ring rotates in a vertical circular plane.

3. The device of claim 1, wherein the solution collection region comprises a receptacle, with the container fluidly coupled to the receptable, wherein bubble solution that drips from the plurality of bubble rings is collected at the receptacle and drips back into the container.

4. The device of claim 1, further including a power source coupled to the motor.

5. The device of claim 4, further including a plurality of LED lights coupled to the power source.

6. The device of claim 1, wherein the plurality of bubble rings comprises four bubble rings.

7. The device of claim 1, wherein each of the plurality of bubble rings is oval shaped.

8. The device of claim 1, wherein the first gear has at least one pusher which applies pressure on the tubing when the trigger is pressed.

9. The device of claim 1, wherein the pump system further includes a spring which normally biases the pivot member into the non-bubble-generating position.

* * * * *